252-95 AU 157 EX
4/8/86 XR 4,581,074

United States Patent [19]
Mankina et al.

[11] Patent Number: 4,581,074
[45] Date of Patent: Apr. 8, 1986

[54] METHOD FOR CLEANING INTERNAL HEAT TRANSFER SURFACES OF BOILER TUBES

[76] Inventors: Nadezhda N. Mankina, stantsia Perlovskaya, ulitsa Ulyanovskaya, 59, Moskovskaya oblast; Valentina Y. Kaplina, ulitsa Matveevskaya, korpus 1, kv. 2, dom 28, Moscow; Ivan A. Govorukhin, prospekt Vernadskogo, 93, korpus 1, kv. 41, Moscow; Nikolai I. Gruzdev, Sumskaya ulitsa, dom 6, korpus 2, kv. 9, Moscow; Jury E. Mishenin, Jurlovsky proezd, 7, kv. 422, Moscow; Nester I. Serebryannikov, 2 Kotelnichesky pereulok, 5, kv. 65, Moscow; Boris S. Fedoseev, ulitsa Glagoleva, 30, korpus 4, kv. 493, Moscow, all of U.S.S.R.

[21] Appl. No.: 463,600

[22] Filed: Feb. 3, 1983

[51] Int. Cl.[4] ..... B08B 3/08; B08B 9/02
[52] U.S. Cl. ..... 134/2; 134/22.12; 134/22.15; 134/36; 148/6.35; 252/95
[58] Field of Search ..... 134/36, 2, 22.15, 22.16, 134/22.18, 30, 22.12; 252/80, 95, 68; 122/384, 389, 390, 392, 405; 422/10, 11; 165/95; 148/6.35

[56] References Cited

U.S. PATENT DOCUMENTS

| | | | |
|---|---|---|---|
| 1,470,359 | 10/1923 | Greenstreet | 134/22.15 |
| 3,084,076 | 4/1963 | Loucks et al. | 134/36 |
| 3,173,874 | 3/1965 | Sewell et al. | 252/95 |
| 3,297,481 | 1/1967 | Newman | 134/36 |
| 4,282,715 | 8/1981 | Edwall et al. | 252/68 |

FOREIGN PATENT DOCUMENTS 651189 3/1979 U.S.S.R. .

OTHER PUBLICATIONS

Defense Science Journal, "Removal of External Deposits on Boiler Tubes", Jul. 1970, pp. 195-200, De et al. "Chemical Cleaning of Heat-Power Equipment", Issue 2, Moscow, Energia, 1978, pp. 6, 7, 30, 31; Margulova. "Power Plant Engineering", No. 1, 1980, pp. 42-45, Aleinikov et al.

*Primary Examiner*—Jay H. Woo
*Assistant Examiner*—Joye L. Woodard
*Attorney, Agent, or Firm*—Burgess, Ryan & Wayne

[57] ABSTRACT

A method for cleaning and removing iron oxide deposits from the internal heat transfer surfaces of boiler tubes, which consists in purging the tubes with superheated steam and oxygen driven at a speed of 20 to 80 m/sec. The oxygen content is 0.3 to 1.0 kg per ton of steam. The process both cleans and passivates the metal surfaces of the tubes.

4 Claims, No Drawings

METHOD FOR CLEANING INTERNAL HEAT TRANSFER SURFACES OF BOILER TUBES

FIELD OF THE INVENTION

The present invention relates to chemical treatment of internal heat surfaces of power generating equipment. More specifically, it is concerned with a method for cleaning internal heat surfaces of power generating equipment.

BACKGROUND OF THE INVENTION

According to a well-known method for cleaning surfaces of power generating equipment, these surfaces are washed with an aqueous solution of a preset composition. Prior to washing, the surfaces are purged with steam.

Purging with steam is done for mechanical removal of loose deposits. Iron oxides, which firmly adhere to the surface of power generating equipment, are removed by washing that surface with aqueous solution of a mixture of Trilon B and citric acid. The final step of the process is the passivation of the metal with sodium nitrite or some other corrosion inhibitor (cf. "Chimicheskiye ochistki teploenergeticheskogo oborudovaniya"/"Chemical Cleaning of Heat-Power Equipment"/, Issue 2 ed. by T. Margulova, Energia Publishers, Moscow, 1978, pp. 6, 31). The method is disadvantageous in that it necessitates the use of short-supply and expensive products and purification of effluents. It also involves extensive preparatory work even with the fullest possible utilization of the available power generating equipment.

There is further known a method for chemical cleaning of internal heat surfaces of power generating equipment, which consists in filling the inside of power generating equipment with moist steam fed at a speed of 6 to 8 m/sec. The steam is maintained at a temperature of 150° C. and has a water content of about 5 percent. Concentrated solution of ammonium salt of ethylene diamine tetraacetic acid (200 to 250 g/l) is added to the moist steam at a rate of 1.5 ton per hour. Also added to the moist steam is a mixture of corrosion inhibitors (the concentration of each is 200 g/l), which is fed at a rate of 0.25 ton per hour (cf. the journal "Energomachinostroyeniye"/"Power Plant Engineering"/, No. 1, 1980, pp. 42–45). The treatment is carried out for 7 hours with a high concentration of the detergent in the moist steam, which amounts to about 200 g/kg. It is followed by purging the equipment with superheated steam, which is carried out over a brief period of time. The method is disadvantageous in that even with a low content of water in the steam the distribution of water inside the equipment being cleaned is not uniform enough, wherefore the removal of deposits is not complete. In addition, the method necessitates the use of short-supply and costly chemical products, as well as the use of special equipment for the purification of effluents.

There is known a method for cleaning internal heat surfaces of power generating equipment according to USSR Inventor's Certificate No. 651,189 of 1972, Cl. F 28 G 13/00. This method consists in washing internal heat surfaces of power generating equipment with aqueous acid solutions and simultaneously filling and heating the inside of the equipment with steam having a temperature of 300° C. to 500° C. The inside of the equipment is then filled with oxygen and washed again with aqueous acid solutions.

The method is too complicated, because a complete removal of deposits from internal heat surfaces of power generating equipment requires multiple cleaning with the use of chemically aggressive reagents. The method according to the above-mentioned USSR Inventor's Certificate involves two cleaning cycles with the use of aqueous solution of hydrochloric acid. Cleaning pipes by filling and heating them with superheated steam and then filling them with oxygen is not effective enough. It takes much time, to say nothing of the fact that it requires additional equipment, including effluent purification installations.

SUMMARY OF THE INVENTION

It is an object of the present invention to facilitate the cleaning of internal heat surfaces of power generating equipment and make the cleaning both more effective and economical.

The foregoing object is attained by providing a method for cleaning internal surfaces of power generating equipment by filling the inside of the equipment with superheated steam and oxygen, which is characterized, according to the invention, in that superheated steam and oxygen are simultaneously fed to the inside of the equipment which is then purged with superheated steam and oxygen driven at a speed of 20 to 80 m/sec, and in that the oxygen content is 0.3 to 1.0 kg per ton of steam. The result of the process according to the invention is clean and passivated internal heat surfaces of power generating equipment.

It is preferable that oxygen required for the cleaning process be obtained by feeding hydrogen peroxide to the inside of the power generating equipment in an amount of 0.6 to 2.0 kg per ton of steam.

In order to ensure adequate cleaning and passivation of internal heat surfaces of power generating equipment, the filling and purging of the inside of the equipment with superheated steam and oxygen driven at a specified speed should be carried out at a temperature of 170° C. to 450° C. during 1 to 5 hours.

The method according to the invention facilitates the cleaning of internal heat surfaces of power generating equipment, because it dispenses with multiple cleaning, chemically aggressive detergents and effluent purification installations. The method is further advantageous in that apart from thorough cleaning of internal heat surfaces of power generating equipment, it provides for passivation of those surfaces.

DETAILED DESCRIPTION OF THE INVENTION

The method according to the invention for cleaning of internal heat surfaces of power generating equipment is carried out as follows.

The inside of power generating equipment is filled and purged with superheated steam having a temperature of 170° C. to 450° C. and driven at a speed of 20 to 80 m/sec. Simultaneously oxygen is added to the superheated steam in an amount of 0.3 to 1.0 kg per ton. The cleaning process is thus carried out for 1 to 5 hours.

The dense layer of iron oxides adhering to internal heat surfaces of power generating equipment largely consists of ferrous oxide FeO which is thermodynamically unstable and tends to become $Fe_3O_4$ or $Fe_2O_3$ which are more stable. In the course of cleaning, the phase composition and structure of the deposit change as follows:

$$4FeO + O_2 \xrightarrow{t} 2Fe_2O_3, \quad (1)$$

$$6FeO + O_2 \xrightarrow{t} 2Fe_3O_4, \quad (2)$$

$$2FeO + H_2O_2 \xrightarrow{t} Fe_2O_3 + H_2O\uparrow, \quad (3)$$

$$3FeO + H_2O_2 \xrightarrow{t} Fe_3O_4 + H_2O\uparrow. \quad (4)$$

A change of the phase composition affects the structural strength of the deposit which is removed due to a high speed of superheated steam in the range of 20 to 80 m/sec.

Due to a high temperature and the presence of an oxidizer, a protective film of magnetite is produced on the cleaned metal surfaces:

$$3Fe + 2O_2 \xrightarrow{t} Fe_3O_4. \quad (5)$$

Thus no additional passivation of the cleaned surfaces is required.

Superheated steam is fed from an adjoining power unit at a flow rate of 160 to 300 tons per hour and under a pressure of 8 to 40 atmospheres. Oxygen is added to superheated steam from bottles where it is maintained at a pressure of 150 atmospheres. Suction of air through the steam ejector is also possible. The power generating equipment is filled and purged with superheated steam through the evaporating circuit. Superheated steam is driven at a specified speed with oxygen being added thereto through the same evaporating circuit. Superheated steam and oxygen are fed in the direction counter to that of the flow of the working medium. In the superheater steam circuit, the direction of the steam flow is parallel to that of the working medium.

As the power generating equipment is being filled with superheated steam, one may also add hydrogen peroxide in an amount of 0.6 to 2.0 kg per ton of steam. Hydrogen peroxide is fed by a pump complete with a metering unit. The invention will now be described with reference to specific examples illustrating the way the proposed method for cleaning internal heat surfaces of power generating equipment is carried out.

Superheated steam is directed at a pressure of 8 atm and a temperature of 175° C., or at a pressure of 40 atm and a temperature of 450° C., at the heat surface of the boiler which has to be cleaned. The flowrate of steam is 160 tons per hour and it traverses the surface being cleaned at a speed of 30 m/sec. Just before superheated steam reaches the surface to be cleaned, oxygen is added to it from a bottle in an amount of 0.80 kg per ton of steam. Prior to purging with superheated steam and oxygen, the amount of deposit in the pipes was as high as 100 to 150 g/m$^2$. After the purging, it went down to a minimum of 7 g/m$^2$ and a maximum of 8 g/m$^2$, which means a complete removal of the deposit for all practical purposes. The cleaning time was one hour.

Another example is using superheated steam at a temperature of 450° C. to clean pipes with 200 g of deposit per one square meter.

95 percent of the deposit was removed after five hours of cleaning.

The method according to the invention removes almost all deposits. The choice of the process parameters is determined by the following considerations. The specified lower temperature of superheated steam, namely 170° C., and the lower oxygen flowrate of 0.3 kg/t correspond to the rate of phase and structural transformation of iron oxides with an amount of deposit below 100 g/m$^2$. The removal of deposits heavier than 100 g/m$^2$ makes it necessary to accelerate the rate of phase and structural transformation of the deposit, for which purpose the superheated steam temperature is raised to 450° C. and the amount of oxygen added to the steam is increased to 1.0 kg/t. The cleaning time also depends on the amount of deposit that has to be removed. With the amount of deposit below 100 g/m$^2$, the cleaning time does not exceed one hour. If the deposit is heavier than 100 g/m$^2$ effective cleaning with superheated steam having a temperature of 450° C. takes at least five hours.

The lower superheated steam speed limit of 20 m/sec is just sufficient for effective mechanical removal of deposits from internal cavities of power generating equipment. The upper speed limit is set at 80 m/sec, because higher speeds lead to erosion of surfaces being cleaned.

What is claimed is:

1. A method for cleaning and removing iron oxide deposits from the internal heat transfer surfaces of metal boiler tubes comprising the steps of filling and purging the tubes with a mixture of superheated steam and oxygen driven at a speed of 20 to 80 m/sec, said mixture having an oxygen content of 0.3 to 1.0 kg per ton of steam, reacting said oxygen with the iron oxide deposits to loosen the latter, removing the loosened deposits from the tubes with the driven mixture, wherein said oxygen content simultaneously serves to passivate the metal surfaces of the boiler tubes.

2. A method as claimed in claim 1, whereby said oxygen is obtained by feeding hydrogen peroxide to the inside of said boiler tubes in an amount of 0.6 to 2.0 kg per ton of steam.

3. A method as claimed in claim 1, whereby the temperature of the superheated steam and oxygen mixture is 170° C. to 450° C. and the purging is carried out for 1 to 5 hours.

4. A method as claimed in claim 2, whereby the temperature of the superheated steam and oxygen mixture is 170° C. to 450° C. and the purging is carried out for 1 to 5 hours.

* * * * *